US005224298A

United States Patent [19]

Horst

[11] Patent Number: 5,224,298

[45] Date of Patent: Jul. 6, 1993

[54] WINDOW TOOLS

[76] Inventor: Chester G. Horst, Rte. 1 Box 157, Annville, Pa. 17003

[21] Appl. No.: 969,390

[22] Filed: Oct. 29, 1992

[51] Int. Cl.[5] ..... E06B 3/00

[52] U.S. Cl. ..... 49/506

[58] Field of Search ..... 49/506, 507, 161; 16/87 R; 81/485, 486, 488; 248/200.1, 354.1-354.7

[56] References Cited

U.S. PATENT DOCUMENTS

| | | | |
|---|---|---|---|
| D. 324,328 | 3/1992 | Pagan | D8/376 |
| 468,987 | 2/1892 | Fowler et al. | 248/354.6 |
| 670,585 | 3/1901 | Fowler . | |
| 2,594,605 | 4/1952 | Zoppelt | 211/123 |
| 2,919,134 | 12/1959 | Zuro | 272/83 |
| 2,967,592 | 1/1961 | Stein | 189/26 |
| 3,350,120 | 10/1967 | Hinrichs | 287/58 |
| 3,411,747 | 7/1968 | Lister et al. | 254/1 |
| 4,075,851 | 2/1978 | Gardner | 49/506 |
| 4,644,691 | 2/1987 | Wright | 49/161 |
| 4,792,168 | 12/1988 | Kardosh | 292/288 |
| 5,014,466 | 5/1991 | Winner | 49/161 X |

*Primary Examiner*—Peter M. Cuomo
*Assistant Examiner*—Jerry Redman
*Attorney, Agent, or Firm*—Jacobson & Johnson

[57] ABSTRACT

A tool for pivoting a sliding sash from a window frame which has opposed, parallel, compressible jamb liners for holding the sash in sliding engagement with the tool comprising an elongated, rigid jamb liner compression tool which has a first end for engaging one compressible jamb liner, and a second end for engaging the opposed compressible jamb liner of a sliding window, with the jamb liner compression tool having a length sufficient long to compress opposed portions of the jamb liner into the recess when the jamb liner compression tool is located at substantially right angles to the jamb liner to thereby enable the user to pivot the top portion of the sash free of the opposed compressed portions of the jamb liner to enable the user to clean the outside pane of the sash from inside.

10 Claims, 3 Drawing Sheets

WINDOW TOOLS

FIELD OF THE INVENTION

This invention relates generally to window devices, and more specifically, to tools for compressing jamb liners to allow pivoting a sash of a double-hung window to a position where the opposite panes of the sash can be cleaned from the same side.

BACKGROUND OF THE INVENTION

Many models of double-hung windows have sliding sashes which can be opened and pivoted inward for cleaning the outside pane from inside the house. Although pivotable, the sliding sashes must also necessarily fit tightly to prevent leakage and drafts around the window. Generally, a compressible, convex jamb liner extends outward from the window frame into a mating, concave recess located in the edge of the sash. To pivot the sash, the jamb liners must be compressed so that the edges of the sash can clear the jamb liners.

One of the difficulties of applying the side pressure to compress the jamb liner is the need to simultaneously compress the jamb liners on opposite sides of the sash, since generally large, compressive forces are required to press the jamb liner into the jamb liner recess. The present invention provides a tool for compressing opposing jamb liners sufficiently far to allow the user to pivot the sash inward for cleaning.

BRIEF DESCRIPTION OF THE PRIOR ART

U.S. Pat. No. 468,987 shows a curtain rod which fits between the vertical sides of the window and exerts pressure against the vertical sides of the window frame.

U.S. Pat. No. 670,585 shows a curtain rod which is held in place by pressure of the ends of the rods against opposing vertical surfaces of a window casing.

U.S. Pat. No. 2,594,605 shows an adjustable length support bar which exerts pressure against opposing surfaces between which the bar is supported.

U.S. Pat. No. 2,919,134 shows an adjustable length exercise bar which is fixed between two vertical surfaces by pressure exerted at the ends of the bar.

U.S. Pat. No. 2,967,592 shows an extendable pole held between two surfaces.

U.S. Pat. No. 3,350,120 shows another extendable pole secured between spaced-apart surfaces.

U.S. Pat. No. 3,411,747 shows a bar for providing force between two opposing objects.

U.S. Pat. No. 4,792,168 shows a door block comprising an adjustable length tube.

U.S. Pat. No. DE. 324,328 shows a design for a support rod.

BRIEF SUMMARY OF THE INVENTION

Briefly, the present invention comprises a tool to assist a user in pivoting a sliding sash free of opposed, parallel, resilient compressible jamb liners that normally hold a double-hung window sash in sliding engagement with the resilient compressible jamb liners with the tool comprising an elongated, rigid member which has a first end for engaging one compressible jamb liner, and a second end for engaging the opposed compressible jamb liner, with the member having a length sufficient long to compress opposed portions of the jamb liner into the jamb liner recess when the elongated rigid member is located at substantially right angles to the jamb liner to thereby enable the user to pivot the top portion of the sliding window free of the opposed compressed portions of the jamb liner.

DESCRIPTION OF THE PREFERRED EMBODIMENT

Figure 6:
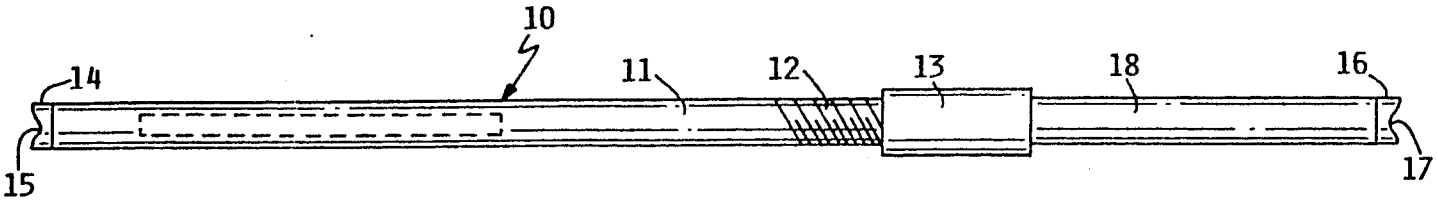
FIG. 6 shows a front view of the jamb liner compression tool.

Referring to FIG. 6 reference numeral 10 generally identifies the jamb liner compression tool of the present invention. Jamb liner compression tool 10 comprises a first rigid member 11 having a male thread 12 on one end for engaging a female thread (not shown) located in coupling 13. A further rigid member 18 extends out of coupling 13 and has an end 16 having a contoured surface 17 which mates with a jamb liner. Similarly, the opposite end of tool 10 has end member 14 with a contoured surface 15 for also mating with a jamb liner.

The embodiment shown in FIG. 6 is such that it can lengthened or shortened by rotating coupling 13 with respect to male threads 12; that is, since all double-hung windows do not have the same width, one may want to lengthen or shorten tool 10 to make the tool usable with different sized windows. The use of male threads 12 and female threads in coupling 13 allows for extension or contraction of jamb liner compression tool 10 by rotation of coupling 13. Although male and female threads are shown as the means for extending or contracting jamb liner compression tool 10, other means could be used. In addition tool 10 includes a region, shown in dotted lines, where advertising information or the like can be placed on tool 10.

Figure 1:
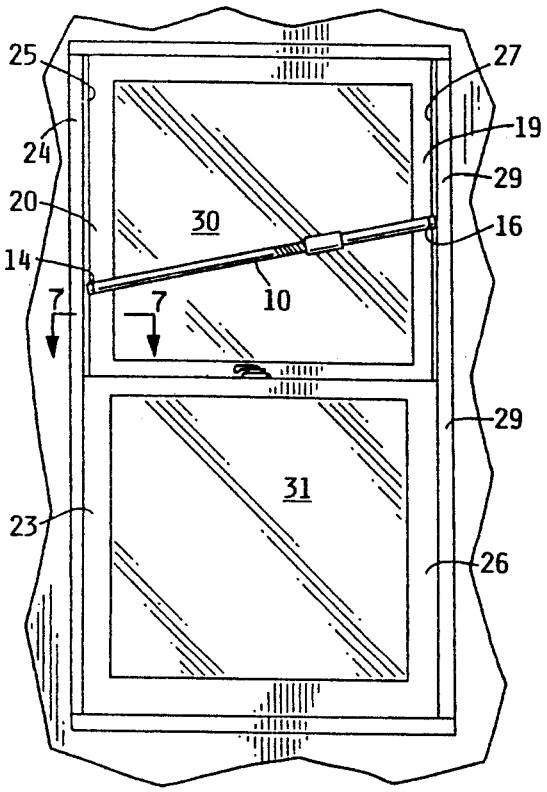
FIG. 1 shows a jamb liner compression tool with the jamb liner compression tool in a non-compressed.
Figure 2:
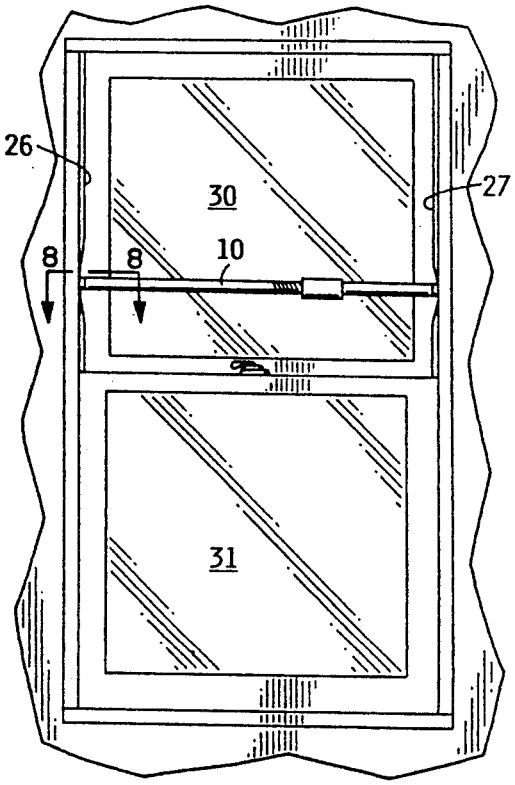
FIG. 2 shows a plane view of a window with the jamb liner compression tool in a compressing position.

To understand the sliding operation of tool 10, reference should be made to FIG. 1. Reference numeral 30 identifies a slidable, top, double-hung sash, and reference numeral 31 identifies a slidable, bottom, double-hung sash. Reference numeral 20 identifies a left sash frame member or stile, and reference numeral 19 identifies a right sash frame member or stile of sash 30. Similarly, reference numeral 23 identifies the lower left sash frame member, and reference numeral 26 identifies the lower right sash frame member of sash 31. Reference numeral 25 identifies the left compressible jamb liner along which one side of sash 31 slides along, and reference numeral 27 similarly identifies the right opposed jamb liner which the opposite side of sash 31 slides along.

Figure 8:
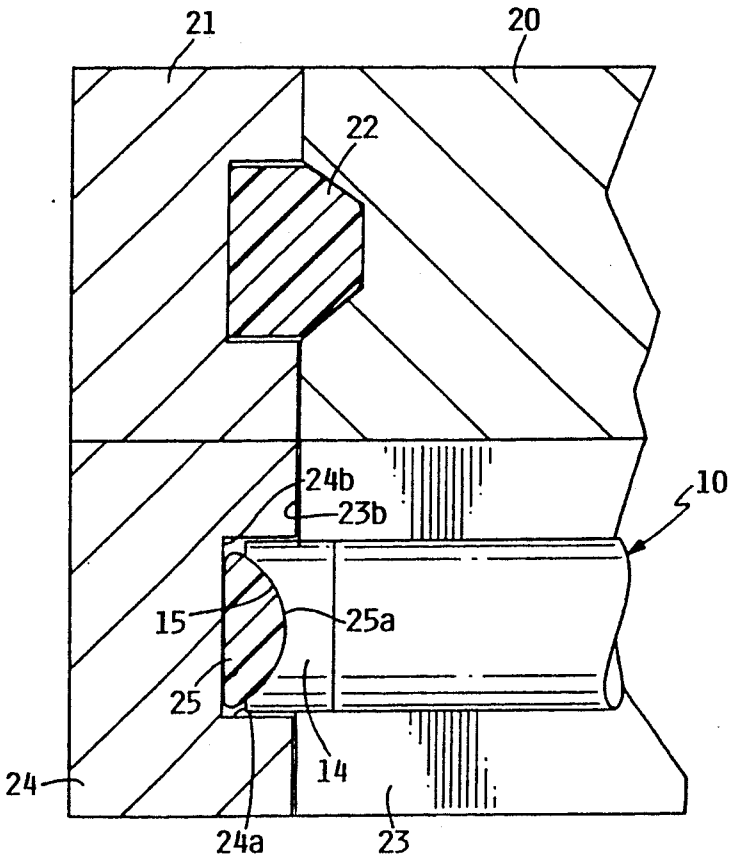
FIG. 8 shows a cross-sectional view taken along line 8-8 of FIG. 2.
Figure 7:
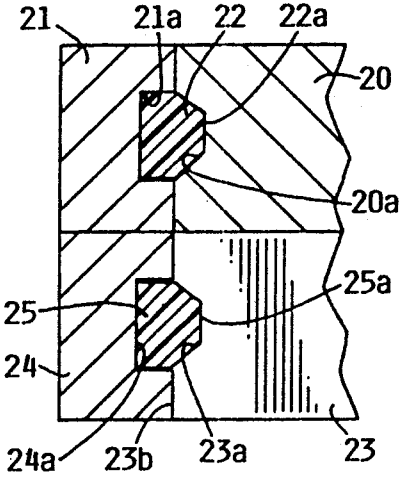
FIG. 7 shows a cross-sectional view taken along line 7-7 of FIG. 1.

To illustrate in detail, the relationship of the jamb liners to the sliding sash, reference should be made to FIGS. 7 and 8. FIG. 7 illustrates the left sash frame member 20, compressible jamb liner 22 and a stop 21. Jamb liner 22 is located in a recess **21*a* and is made of a compressible but resilient material and contains a convex outer surface 22a which mates with a concave-shaped recess 20a extending along the edge of sash frame member 20. Similarly, a parallel, spaced jamb liner 25 has a convex exterior surface 25a which mates with a concave-shaped recess 23a extending along the edge of sash frame member 23. A stop 24 contains a recess 24a which holds compressible but resilient jamb liner 25** therein.

Since jamb liner convex surface 25a extends into the concave recess 23a of sash 23, it creates a tortuous path, thereby hindering drafts from penetrating a window, yet still permitting a sash to slide up and down along jamb liner 25. However, to pivot the lower sash 31 inward, the compressible jamb liners 25 and 27, which fit snugly against the edge of the left sash member 23 and the right sash member 26 must be compressed so that window sash 31 is free of jamb liners 25 and 27.

To illustrate the freeing of the window sash frame member 23 so that it may be swung free of jamb liner 25, reference should be made to FIG. 8 where jamb liner 25 is shown in a compressed condition. The jamb liner compression tool 10 is shown in an extended position with end 14 fitting into recess 24a and compressing jamb liner 25 into recess 24a to an extent that end surface 23b of sash frame member 23 is free of end surface 25a on compressible jamb liner 25. In this position, the sash frame member 23 can be pivoted free of stop 24.

Figure 3:
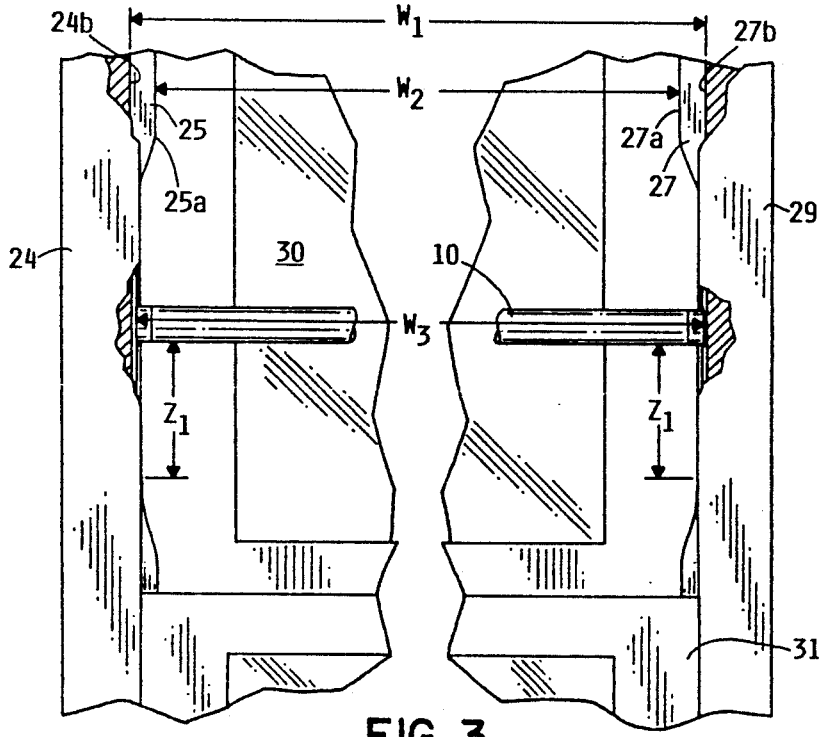
FIG. 3 shows a partial cutaway of FIG. 2.

FIG. 3 illustrates the dimensional relationships of jamb liner compression tool 10 in the sash frames 24 and 29. Reference character $w_1$ denotes the distance from the bottom of jamb liner recess channel 24b to the bottom of jamb liner recess channel 27b. Reference character $w_2$ denotes the peak-to-peak distance between jamb liner surface 25a and jamb liner top surface 27a. Reference character $w_3$ denotes the length of jamb liner compression tool 10. The length of jamb liner compression tool 10 is sufficiently long to compress opposed portions of the jamb liner into the recesses for the jamb liner when the elongated rigid jamb liner and compression tool is located at substantially a right angle to the jamb liners to thereby permit the user to swing the top portion of the sash free of the opposed, compressed portions of the compressible jamb liners 25 and 27.

To illustrate the jamb liner compression tool 10 and its use, reference should be made to FIGS. 1-5. FIG. 1 shows jamb liner compression tool 10 located in a diagonal position on opposed jamb liners 27 and 25. In this condition, the jamb liners are not compressed, but end 14 of jamb liner compression tool 10 is engaged with jamb liner 25 and opposite end 16 of jamb liner compression tool 10 is engaged with jamb liner 27. In the next step, the jamb liner is brought to a position parallel to the bottom sash and perpendicular to jamb liners 25 and 27, thus causing the jamb liner compression tool 10 which has a length $w_3$, which is longer than the width $w_2$ between jamb liners but shorter than the distance $w_1$ between the bottoms of jamb liner recesses 25 and 27 to compress the jamb liner proximate the ends of tool 10.

Figure 4:
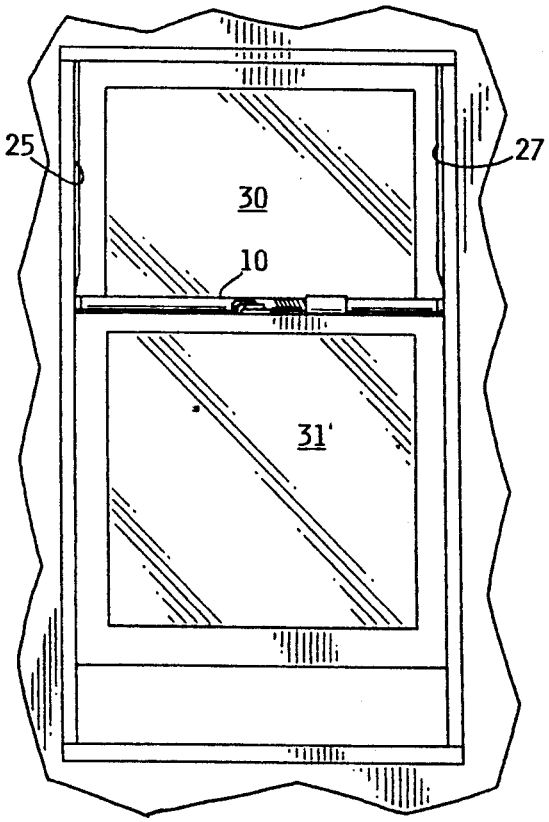
FIG. 4 shows the lower sash of a double-hung window raised to a position to be pivoted inward.

As can be seen in FIGS. 3 and 4, compression of the jamb liners 25 and 27 causes a portion of the jamb liners proximate the ends of the compression tool to be pushed inward clear and free of stops 24 and 29, thus allowing a user to pivot the top of sash 31 out of the frame. Reference characters $z_1$ indicates the length of the jamb liner that has been forced free and clear of the end of sash 31.

Figure 5:
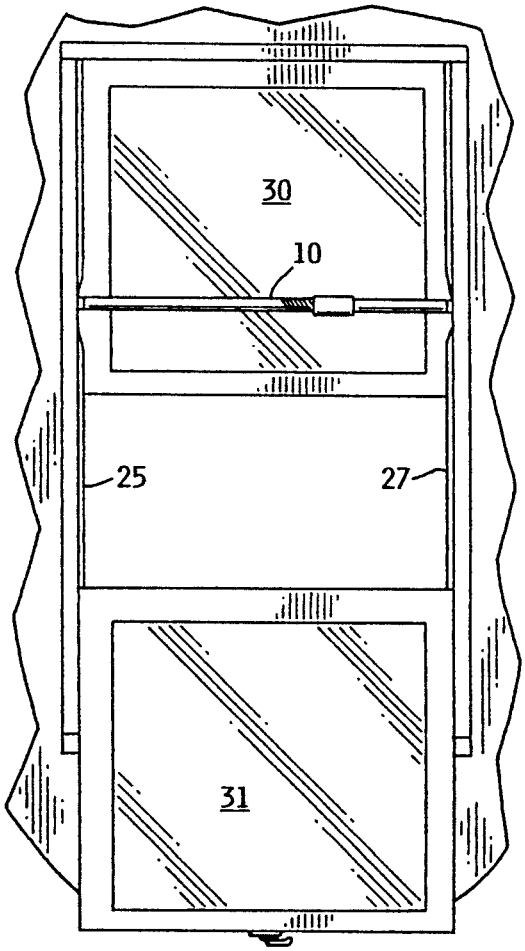
FIG. 5 shows the lower sash of double-hung window titled inward for cleaning.

FIG. 4 illustrates that once jamb liner compression tool 10 has been placed in cross position compressing the jamb liners 25 and 27, the lower sash is slid upward until the top portion of sash 31 is adjacent to jamb liner compression tool 10. In the next step, the operator pulls outward on the top of sash 31, causing sash 31 to pivot downward with the outside surface of the sash available for washing (FIG. 5).

I claim:

1. A device for compressing jamb liners to enable a user to pivot a sliding sash free of opposed parallel compressible jamb liners supported in recesses with the improvement comprising:

an elongated, rigid member having a first end for engaging a first resilient compressible jamb liner and a second end for engaging a second opposite resilient compressible jamb liner, said elongated, rigid member having a length sufficiently long to compress the first and second resilient compressible jamb liners into their respective jamb liner recesses when the elongated, rigid member is located at substantially right angles to the jamb liners to free an end of a sliding sash to thereby enable the user to pivot the sliding sash free of the opposed compressed portions of the jamb liners.

2. The device of claim 1 wherein said rigid member comprises a cylindrical member.

3. The device of claim 2 wherein said rigid member has an end with a dimension that is less than a width of the compressible jamb liner recess to thereby fit into the compressible jamb liner recess during compression of the jamb liner.

4. The device of claim 1 wherein said elongated, rigid member includes means for shortening or extending the length of said rigid member.

5. The device of claim 4 wherein said means includes a male threaded section and a female threaded section.

6. The device of claim 1 wherein said rigid member includes a space for printing information thereon.

7. The device of claim 1 wherein said rigid member has a length less than the distance between the bottoms of compressible jamb liner recesses.

8. The device of claim 1 wherein said first end has a concave shape for mating with the first compressible jamb liner and said second end has a concave shape for mating with the second compressible jamb liner.

9. The device of claim 8 wherein said concave shape of said first end and said second end substantially conforms to the shape of the compressible jamb liner for engaging a sliding window.

10. A method of pivoting a sliding sash having ends and held in a sliding relationship between a pair of parallel opposed and compressible jamb liners comprising the steps of:

placing an elongated, rigid member having a length equal to or greater than a sliding sash at an acute angle to each of a pair of opposed parallel compressible jamb liners;

pivoting the elongated, rigid member until it is at substantially parallel to a top portion of the sliding sash and perpendicular to the compressible jamb liners to compress the compressible jamb liners into their recess so the compressible jamb liners proximate the elongated, rigid member are free of the ends of the sliding sash;

sliding the sliding sash upwards until a top portion of the sliding sash to be pivot for cleaning is proximate the elongated, rigid member; and then pivoting the sliding sash free of the compressible jamb liners to allow for cleaning both sides of the sliding sash from the same side.

* * * * *